US009719225B2

(12) United States Patent
Abeles

(10) Patent No.: US 9,719,225 B2
(45) Date of Patent: Aug. 1, 2017

(54) PORTABLE WATER INFLATABLE BARRIER WITH WATER INFLATABLE BASE

(71) Applicant: Gary E Abeles, Verona, NJ (US)

(72) Inventor: Gary E Abeles, Verona, NJ (US)

( * ) Notice: Subject to any disclaimer, the term of this patent is extended or adjusted under 35 U.S.C. 154(b) by 0 days.

(21) Appl. No.: 15/382,965

(22) Filed: Dec. 19, 2016

(65) Prior Publication Data

US 2017/0101758 A1 Apr. 13, 2017

Related U.S. Application Data

(63) Continuation-in-part of application No. 15/016,606, filed on Feb. 5, 2016, now Pat. No. 9,556,574, which is a continuation of application No. 14/594,407, filed on Jan. 12, 2015, now Pat. No. 9,334,616, which is a continuation-in-part of application No. 13/663,756, filed on Oct. 30, 2012, now Pat. No. 8,956,077.

(60) Provisional application No. 61/553,403, filed on Oct. 31, 2011.

(51) Int. Cl.

| | |
|---|---|
| ***E02B 3/10*** | (2006.01) |
| ***E02B 7/00*** | (2006.01) |
| ***E02B 3/16*** | (2006.01) |

(52) U.S. Cl.

CPC ..... *E02B 3/108* (2013.01); *E02B 3/106* (2013.01); *E02B 3/16* (2013.01); *E02B 7/005* (2013.01)

(58) Field of Classification Search

CPC ..... E02B 3/106; E02B 3/108; E02B 7/005
See application file for complete search history.

(56) References Cited

U.S. PATENT DOCUMENTS

| | | | | |
|---|---|---|---|---|
| 3,213,628 | A * | 10/1965 | Serota | E02B 3/108 220/62.21 |
| 3,355,851 | A | 12/1967 | Imbertson et al. | |
| 3,975,915 | A | 8/1976 | Haw | |
| 4,103,496 | A * | 8/1978 | Colamussi | E02B 7/005 405/101 |
| 4,692,060 | A * | 9/1987 | Jackson, III | E02B 3/108 256/13 |

(Continued)

FOREIGN PATENT DOCUMENTS

| | | | |
|---|---|---|---|
| DE | 20309206 | U1 | 9/2003 |
| FR | 2565271 | A1 | 12/1985 |

(Continued)

*Primary Examiner* — Frederick L Lagman

(74) *Attorney, Agent, or Firm* — Maine Cernota & Rardin

(57) ABSTRACT

A portable, water-filled barrier system includes a barrier internally divided into cells that emulates a section of a sandbag dike or wall. Automatic valves can seal openings between the filled cells, so that a punctured cell will not cause cells below and behind to deflate. In embodiments the barrier can be initially filled with air, positioned, and then filled with water while the air escapes through a pressure valve. The system further includes a base with water inflatable front and back panels. The side panels and bottom panel of the base can be water inflatable or flat. The base can be used to increase friction with the ground, protect against stones, and/or to support a leveling wedge or leveling material such as sand or spray foam when located on a sloped surface. A plurality of adjacent bases and barriers can provide an extended barrier system.

20 Claims, 17 Drawing Sheets

(56) References Cited

U.S. PATENT DOCUMENTS 5,059,065 A * 10/1991 Doolaege ..... E02B 7/005 405/107
5,125,767 A * 6/1992 Dooleage ..... E02B 3/108 405/114
5,857,806 A * 1/1999 Melin ..... E02B 3/108 405/114
5,865,564 A * 2/1999 Miller ..... E02B 3/108 405/114
5,993,113 A 11/1999 Darling
6,022,172 A * 2/2000 Siyaj ..... E02B 3/108 405/110
6,481,928 B1 * 11/2002 Doolaege ..... E01D 15/20 138/98
6,551,025 B2 * 4/2003 Dery ..... E02B 3/108 405/115
6,641,329 B1 * 11/2003 Clement ..... E02B 3/108 405/115
7,214,005 B1 * 5/2007 Davis ..... E02B 3/102 405/107
7,357,598 B1 * 4/2008 Bradley ..... E02B 3/108 405/111
8,956,077 B2 * 2/2015 Abeles ..... E02B 3/108 405/111
9,334,616 B2 * 5/2016 Abeles ..... E02B 3/127
9,556,574 B2 * 1/2017 Abeles ..... E02B 3/127
2004/0047688 A1 * 3/2004 Clement ..... E02B 3/108 405/115
2005/0260038 A1 * 11/2005 Sousa Costa ..... E02B 3/127 405/115
2006/0099033 A1 * 5/2006 Boraggina ..... E02B 3/108 405/107
2007/0140598 A1 * 6/2007 McGillick ..... B65D 88/1612 383/22
2007/0237586 A1 * 10/2007 Prestininzi ..... E02B 3/108 405/115
2009/0064598 A1 * 3/2009 Mouyiaris ..... E02B 3/108 52/2.11
2009/0274519 A1 * 11/2009 Shaw ..... E02B 3/108 405/107
2010/0284747 A1 * 11/2010 Peterson ..... E02B 3/108 405/114
2014/0010601 A1 * 1/2014 Bradley, Sr. ..... E02B 3/06 405/302.7

FOREIGN PATENT DOCUMENTS

FR 2860251 A1 * 4/2005 ..... E02B 3/108
GB 2088935 A 6/1982
GB 2451286 A 1/2008
GB 2458941 A 10/2009
KR 820002208 B1 11/1982
KR 101324434 B1 11/2013
SK 50792009 U1 10/2010
WO 2013/167787 A1 11/2013
WO 2016/051002 A1 4/2016

* cited by examiner

PORTABLE WATER INFLATABLE BARRIER WITH WATER INFLATABLE BASE

RELATED APPLICATIONS

This application is a continuation in part of application Ser. No. 15/016,606, filed on Feb. 5, 2016, now U.S. Pat. No. 9,556,574. Application Ser. No. 15/016,606 is a continuation of application Ser. No. 14/594,407, filed on Jan. 12, 2015, now U.S. Pat. No. 9,334,616. Application Ser. No. 14/594,407 is a continuation in part of application Ser. No. 13/663,756, filed on Oct. 30, 2012, now U.S. Pat. No. 8,956,077. Application Ser. No. 13/663,756 claims the benefit of U.S. Provisional Application No. 61/553,403, filed Oct. 31, 2011. All of these applications are herein incorporated by reference in their entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand is brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the barrier 100 is constructed on flat ground, and the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

While a sandbag barrier is generally effective and the materials are relatively inexpensive, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that functions in a manner similar to a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, water inflatable barrier has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier is made of a light, flexible material such as a heavy plastic or nanofiber, and can be transported to the construction site in a deflated state, after which it is positioned and filled with locally available water.

In one general aspect of the present invention, the barrier is a single unit that includes shaping and internal partitions which create an overall structure similar to a sandbag wall. The interior of the barrier is divided into a plurality of approximately rectangular cells. Passages between the tops and bottoms of the cells allow the entire barrier to be filled from a single water inlet. In some embodiments, the cells include passive automatic valves that seal the passages after the cells are filled with water, so that deflation of one cell due to a puncture or some other cause will not cause the cells beneath it to deflate. In some embodiments, the outer shell of the barrier is made of a thicker material, such as thick plastic, a synthetic rubber, or a thick layer of nanofiber, so as to better resist puncture by an external threat. In similar embodiments, the outer shell is double-walled, so that puncture of the outer wall does not affect the internal cells, so long as the inner wall remains intact. In certain embodiments the walls are coated with a protective material such as tyvec or liquid rubber that will seal punctures if they occur.

The unitary nature of the barrier in these embodiments eliminates any concern about interlocking and potential separation of individual units. The internal structure of the barrier enables it to maintain its shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In further embodiments, additional rows of cells extend below the base of the inflatable barrier so that they can be placed in a trench prepared at the construction site; thereby further resisting dislodgement of the barrier by flood waters or other forces.

In some embodiments, the barrier can be initially inflated with air, so that the barrier can be easily positioned while it is in its filled configuration. The barrier can then be filled with water, while the displaced air is released through a pressure valve at the top of the barrier.

In circumstances where a long dyke or other barrier is required, a plurality of barriers of the present invention can be placed side-by-side. In some embodiments, the barriers have interlocking ends that provide structural cooperation and a water-tight seal between adjacent barriers. In some of these embodiments, pre-inflation of the barriers with air allows them to be easily placed in their interlocking configuration before the air within the barriers is replaced by water.

In a second general aspect of the present invention, the barrier is assembled from individual, water inflatable modules that interconnect with each other, by ties, hook-and-loop, or by any other attachment mechanism known in the art. In some of these embodiments, the individual modules are triangular or wedge-shaped in cross section, thereby allowing the modules to be assembled so as to create an overall shape that is optimal for a specific circumstance.

Embodiments of the present invention include an anchoring sheet that surrounds part or all of the barrier, or is otherwise attached to the barrier, and extends flat against the ground in front of the barrier, so that the weight of the water in front of the barrier presses the anchoring sheet against the ground and creates a high frictional resistance to movement, thereby anchoring the barrier in place. In some embodiments, the anchoring sheet covers a water-facing surface of the barrier, and is sufficiently flexible to allow it to conform closely with the underlying shape of the water-facing surface. And in some of these embodiments, the anchoring sheet is made from a material that naturally clings to the water-facing surface of the barrier due to static electrical attraction.

Other embodiments include a flexible underlying sheet that further resists puncture from beneath, and which seals to the ground so as to resist penetration of water beneath the barrier. In some of these embodiments, the underlying sheet includes a cushioning layer. In other of these embodiments, the underlying sheet is filled with dry sand, foam or some other compliant material that will not get wet from the flood water.

In some embodiments, a base width of the barrier is at least six times as large as a height of the barrier.

Embodiments of the present invention include a separate, water inflatable base that can be used to adapt the barrier to various features of the local terrane. The water inflatable base includes front and back panels and two side panels that are configured to surround the barrier. At least the front and back panels of the circumference are water inflatable. In embodiments, support rods such as nylon rods can be inserted into sleeves provided in the side panels and/or the front and back panels for added structural support. In other embodiments, the base is supported entirely by the water filled panels and by the barrier.

The water-inflatable base further includes a bottom panel configured for positioning beneath the barrier. In embodiments, the bottom panel is a single sheet of material, such as a plastic or woven sheet, and includes textural features that are configured to increase frictional attachment to the underlying surface. In other embodiments, the bottom panel of the base is water inflatable, and is able to cushion and isolate the barrier from stones and other irregularities that might be present in the underlying terrain.

Embodiments include a plurality of wedge-shaped inserts that can be placed on top of or beneath the bottom panel of the base so as to provide a level platform for the barrier when the underlying ground is sloped. In method embodiments of the invention, wherein the barrier is to be installed on an inclined or otherwise non-level surface, sand, spray foam, castable urethane, or another material is applied on top of the bottom panel so as to provide a level platform for the barrier.

In embodiments the circumference of the base is water inflatable on two sides and flat on two sides. This can be advantageous, for example, when a plurality of barriers are to be placed adjacent to each other so as to create an elongated barrier.

A first general aspect of the present invention is a water inflatable barrier system that includes a barrier having flexible walls configured to contain water within an interior of the barrier, said barrier having a front, a rear, a length parallel to the front, a width perpendicular to the front, and a substantially uniform cross-section along its length, the cross section being wider at a bottom of the barrier than at a top of the barrier, a plurality of substantially horizontal and substantially vertical partition walls dividing said interior of said barrier into a plurality of adjacent, water-tight cells shaped as rectangular parallelepipeds, front and rear partition walls of each cell being substantially parallel to the front of the barrier shell, said cells being arranged in a plurality of vertically stacked layers that are offset from each other such that none of the front and rear partition walls aligns with a front or rear partition wall in a vertically adjacent layer, a water inlet in liquid communication with the barrier, and a plurality of passages between the cells of the barrier that are configured to allow filling of all of the cells of the barrier with water from the water inlet.

The system further includes a base having a bottom panel configured to underlie the barrier and a front panel, a back panel, and two side panels surrounding and attached to a circumference of the bottom panel, the front and back panels being water inflatable, and the front, back, and side panels being configured to extend above said bottom panel and to encircle the bottom of the barrier when the barrier is placed on the bottom panel.

In embodiments, the bottom panel includes a structural feature on a lower side thereof that increases frictional attachment of the bottom panel to an underlying surface.

In some embodiments, the bottom panel is water inflatable. In various embodiments, the two side panels are water inflatable.

Embodiments further include at least one leveling wedge configured for placement on top of or below the bottom panel so as to provide a substantially level platform for support of the barrier when the base is installed on a sloping surface.

Embodiments further include a support rod that can provide structural support to the base by attachment to one of the panels thereof.

In embodiments, the system further includes an automatic valve cooperative with a vertical passage between adjacent cells and configured to automatically seal the vertical passage when the cell below the vertical passage is filled with water.

Embodiments further include an automatic valve cooperative with a horizontal passage between adjacent cells and configured to automatically seal the horizontal passage when the cell located to the rear of the horizontal opening is filled with water.

In various embodiments the barrier includes an interlocking side structure configured to interlock with a second barrier having a compatible side structure. In some embodiments, the front panel of the base is reinforced due to inclusion of nanofiber in flexible walls thereof. In certain embodiments, the front panel of the base is reinforced due to double-walled construction.

In embodiments, the flexible walls include a coating of a protective material that tends to seal punctures. And in some of these embodiments, the protective material is tyvec or liquid rubber.

And various embodiments further include a plurality of said barriers and bases, the side panels of the bases being non-inflatable flat panels, the barriers and base side panels being placed in an adjacent relationship so as to collectively form a water barrier, damn, or dyke.

A second general aspect of the present invention is a method of constructing a barrier assembly. The method includes providing a barrier having flexible walls configured to contain water within an interior of the barrier, said barrier having a front, a rear, a length parallel to the front, a width perpendicular to the front, and a substantially uniform cross-section along its length, the cross section being wider at a bottom of the barrier than at a top of the barrier, a plurality of substantially horizontal and substantially vertical partition walls dividing said interior of said barrier into a plurality of adjacent, water-tight cells shaped as rectangular parallelepipeds, front and rear partition walls of each cell being substantially parallel to the front of the barrier shell, said cells being arranged in a plurality of vertically stacked layers that are offset from each other such that none of the front and rear partition walls aligns with a front or rear partition wall in a vertically adjacent layer, a water inlet in liquid communication with the barrier, and a plurality of passages between the cells of the barrier that are configured to allow filling of all of the cells of the barrier with water from the water inlet.

The method further includes providing a base configured to underlie and surround the barrier. The base includes a bottom panel configured to underlie the barrier, as well as a front panel, a back panel, and two side panels surrounding and attached to a circumference of the bottom panel, where the front and back panels are water inflatable, and the front, back, and side panels are configured to extend above said bottom panel and to encircle the bottom of the barrier when the barrier is placed on the bottom panel.

The method further includes placing the base at a desired location, inflating the front and back panels of the base with water, placing the barrier on the bottom panel of the base, and inflating the barrier with water.

In embodiments where the side panels of the base are water inflatable, the method further comprising inflating the side panels of the base with water.

In some embodiments where the desired location is sloped, the method further includes, providing a leveling wedge and placing the wedge onto or under the bottom panel of the base, thereby providing a substantially level platform upon which the barrier is placed.

In other embodiments where the desired location is sloped, the method further includes, after placing the base at the desired location, applying a leveling substance onto the bottom panel of the base so as to provide a substantially level platform upon which the barrier is placed. And in some of these embodiments the leveling substance includes at least one of sand, soil, spray foam, and urethane.

And various embodiments further include providing a support rod, and attaching the support rod to the front, rear, or side panel of the base.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
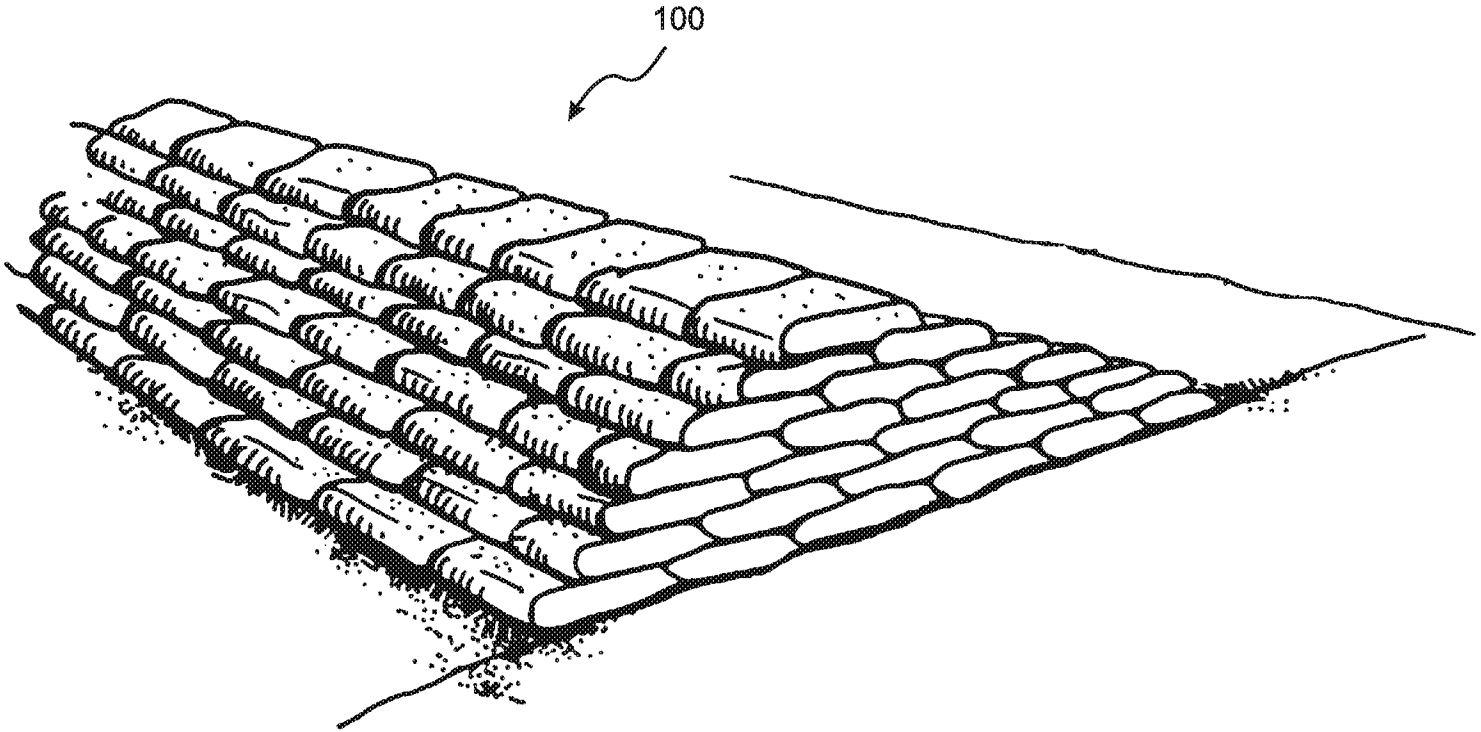
Figure 1 Prior Art
FIG. 1 is perspective view of a sandbag barrier of the prior art having a flat base.
Figure 2:
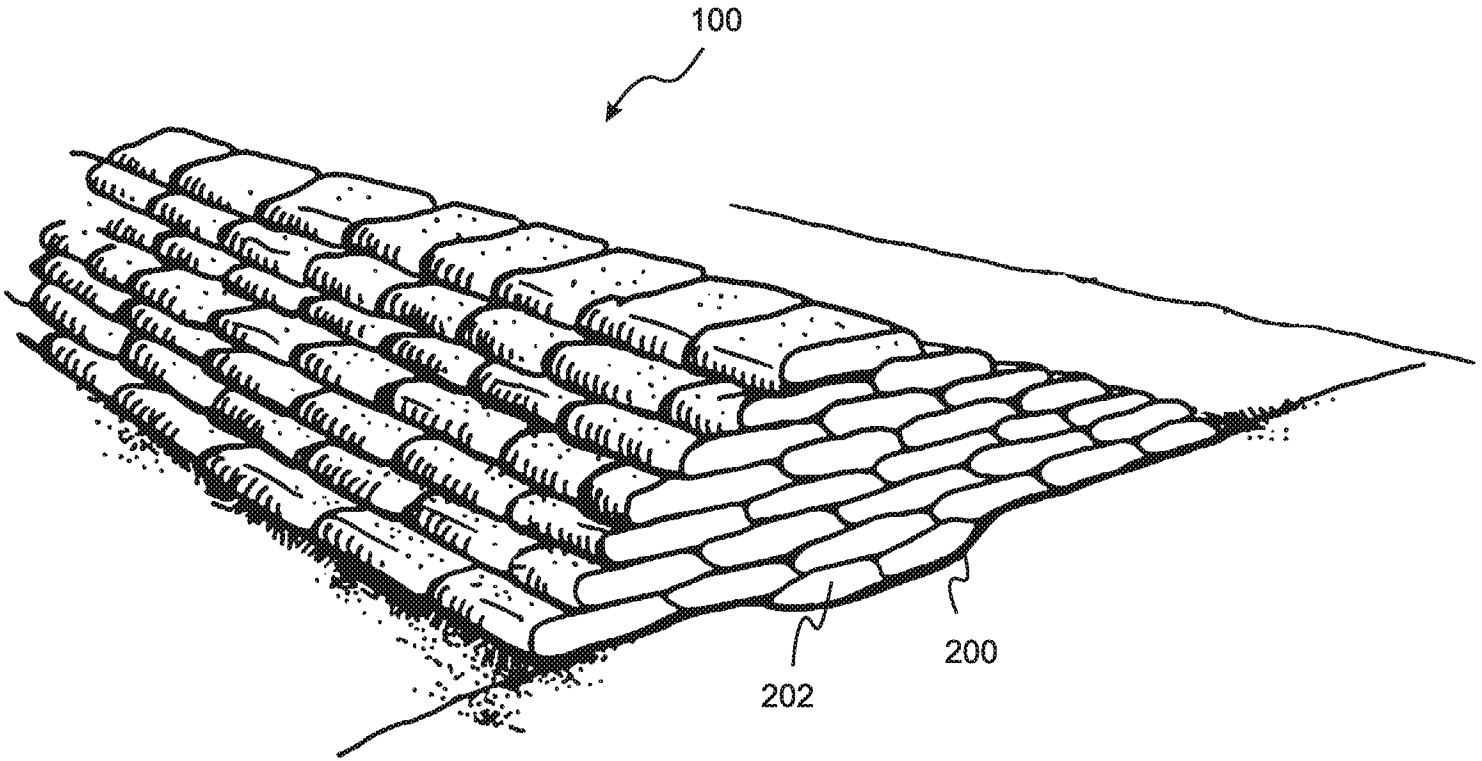
Figure 2 Prior Art
FIG. 2 is perspective view of a sandbag barrier of the prior art having two rows of sandbags at its base that are placed in a trench prepared at the construction site.
Figure 3:
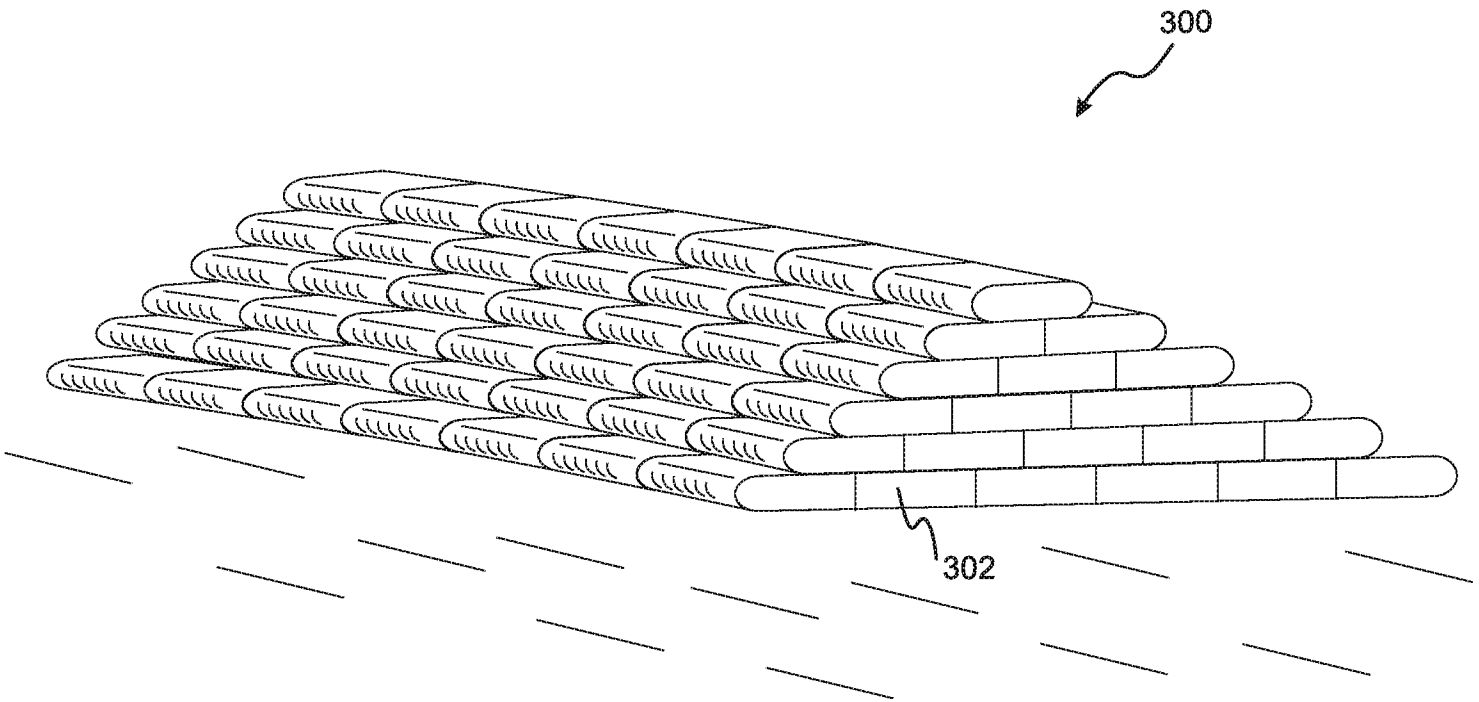
FIG. 3 is a perspective view of an embodiment of the present invention.

With reference to FIG. 3, the present invention is a portable, water inflatable barrier 300 that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. The barrier 300 is made of a light, flexible material, such as a heavy plastic for nanofiber, and can be transported to the construction site in a deflated state, after which it is positioned and filled with locally available water. In embodiments, the barrier material is coated with a material such as tyvec or liquid rubber that will tend to seal any puncture of the material that may occur.

Figure 4A:
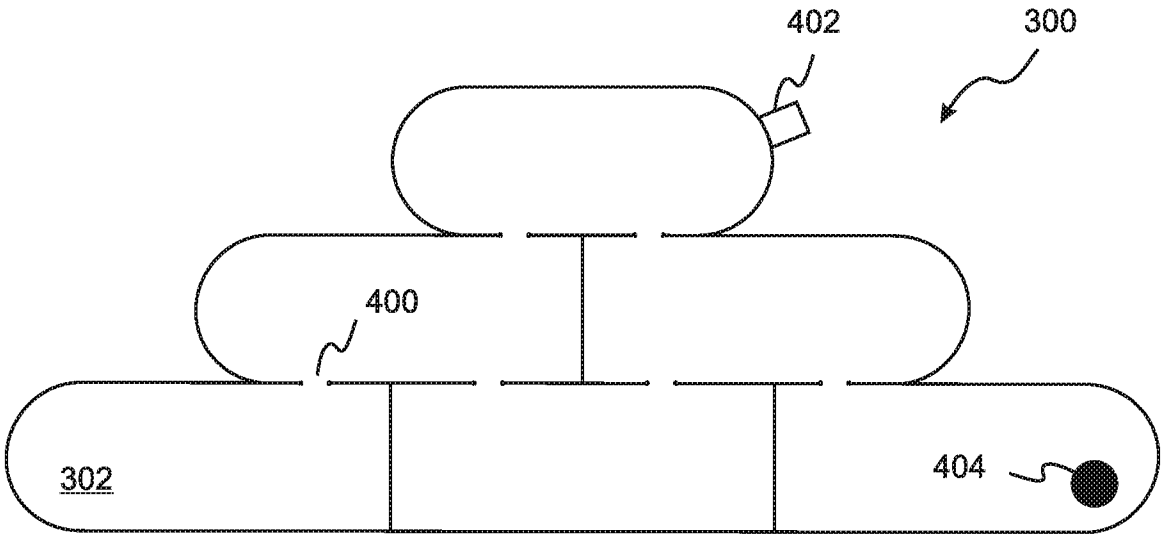
FIG. 4A is a cross sectional view of an embodiment having a water inlet on top, a water outlet near the bottom, and simple passages between tops and bottoms of cells.

FIG. 3 illustrates an embodiment of a first general aspect of the present invention in which the barrier is a single unit 300 that includes shaping and internal partitions which create an overall structure similar to a sandbag wall. The interior of the barrier is divided into a plurality of approximately rectangular cells 302. With reference to FIG. 4A, passages 400 between the tops and bottoms of the cells 302 allow the entire barrier 300 to be filled from a single water inlet 402. A separate water outlet 404 is provided at the base of the structure 300.

Figure 4B:
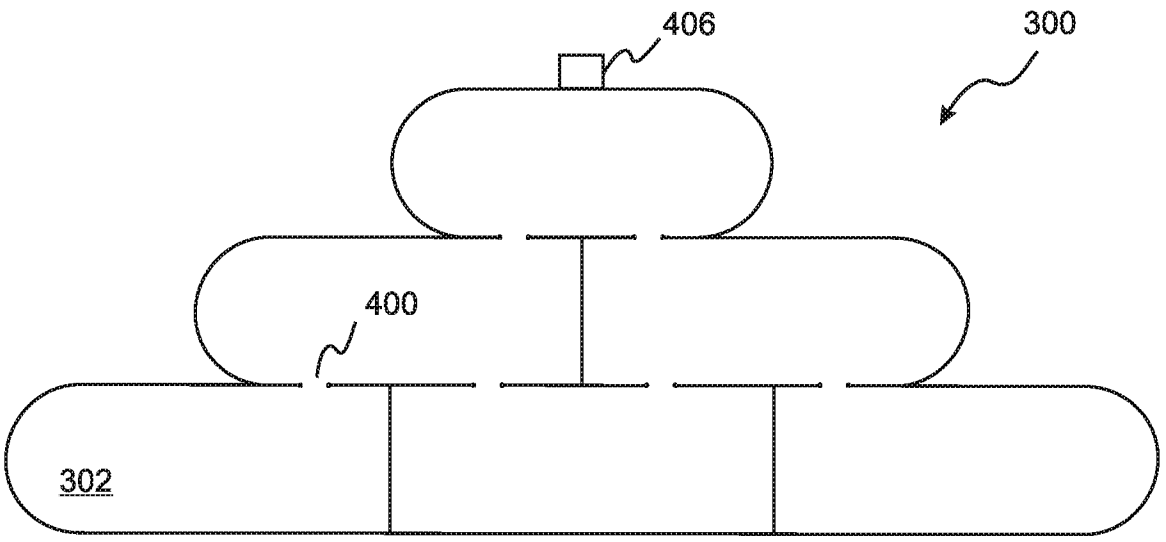
FIG. 4B is a cross sectional view of an embodiment similar to FIG. 4A, but including only a water port at the top through which the barrier is both filled and emptied with water.

With reference to FIG. 4B, in some embodiments a separate water outlet 404 is not included, and instead water is both added and removed through a common port 406 at or near the top of the barrier. This allows water to be removed from the barrier without introducing air, so that removing the water causes the barrier to be collapsed in preparation for packing and transport.

In some embodiments, lateral passages (not shown) are provided at least between adjoining cells in the bottom rear row, so that a single outlet can drain all of the cells 302 in the barrier 300.

Figure 5:
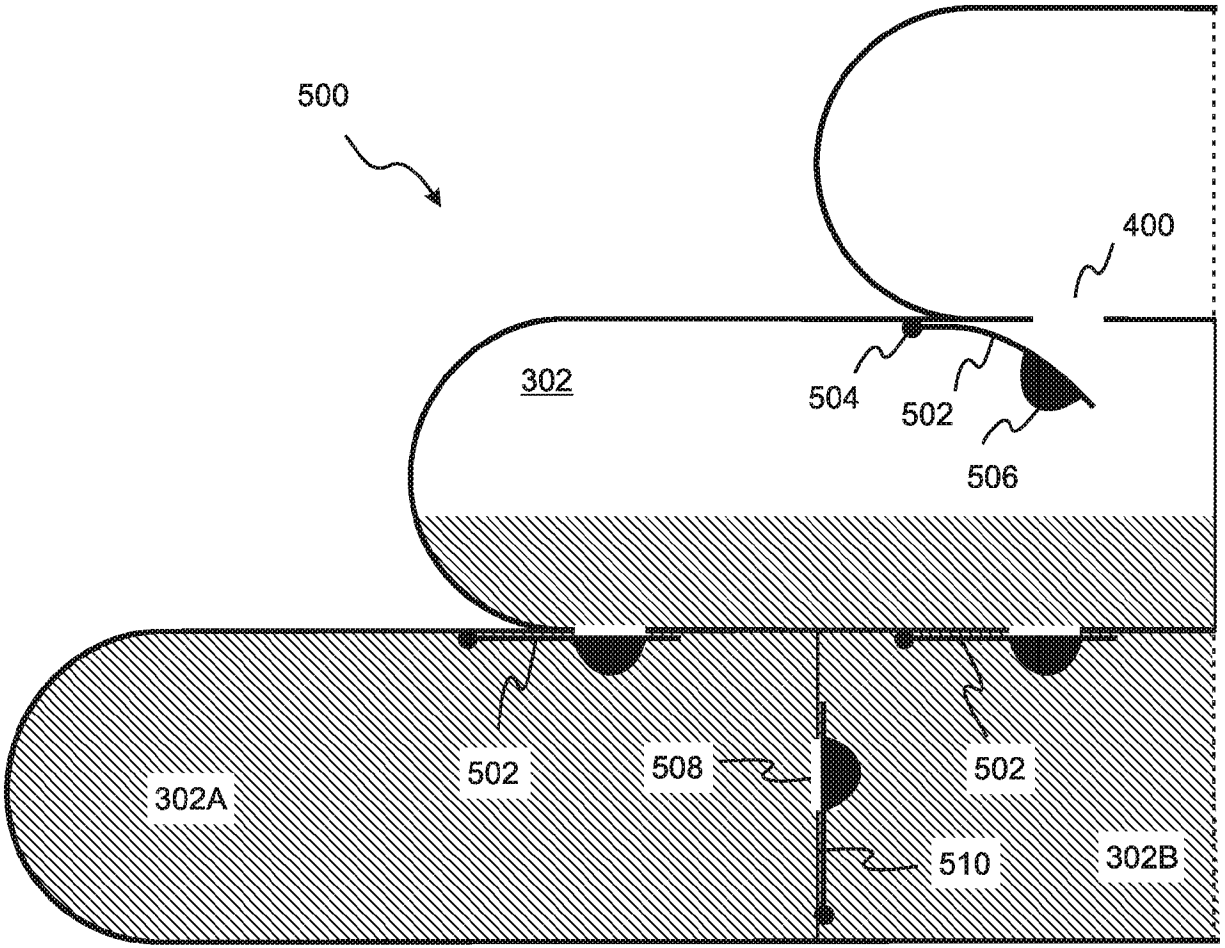
FIG. 5 is a partial cross sectional view of an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6:
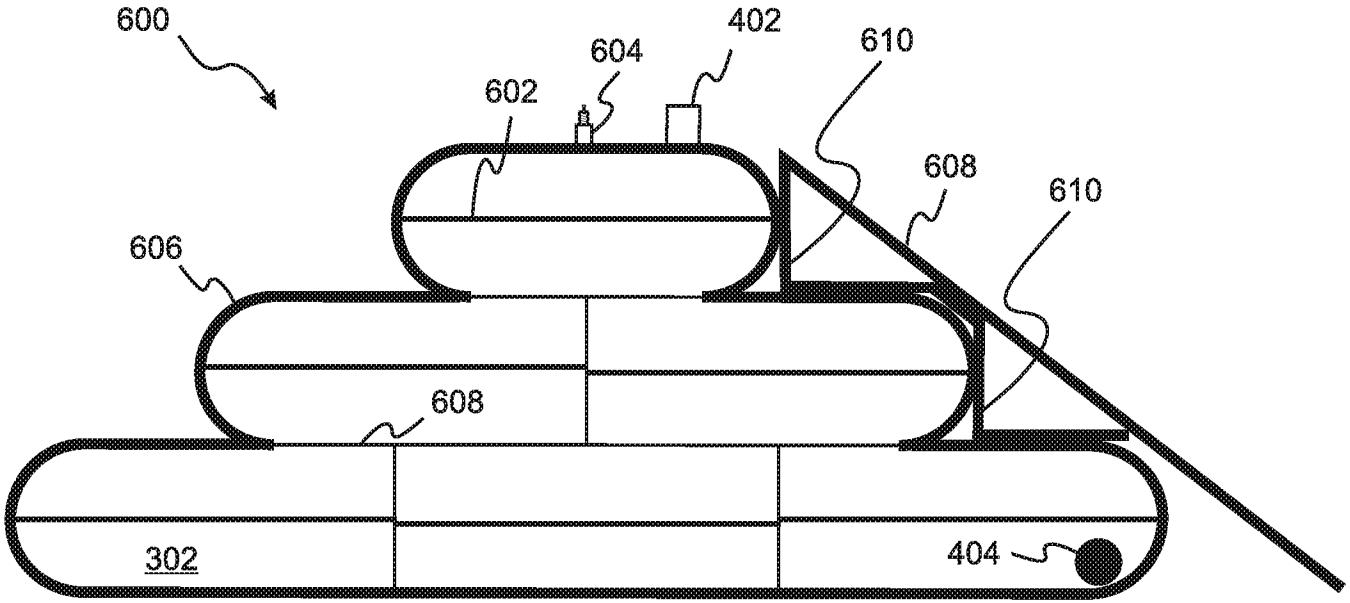
FIG. 6 is a cross sectional view of an embodiment that includes stiffening rods within the cells.

With reference to FIG. 6, in some embodiments the outer shell is made of a much thicker material than the internal cell walls 608, so as to better resist puncture by exterior threats. In similar embodiments, the outer shell 606 is a double layer of material, so that penetration of the outer layer does not affect the adjacent cell, so long as the inner layer remains intact. In some embodiments, only the portion of the outer shell 606 that will face the flood or other threat is thicker, double-walled, or otherwise reinforced.

In embodiments, the internal cell walls enable the barrier 300 to maintain its shape when it is subjected to externally applied lateral forces, such as pressure from flood waters. As illustrated in FIG. 6, in some embodiments, the shape of the barrier 600 is made even more rigid by including within the cells 302 stiff, lightweight rods 602 or panels made of plastic, bamboo, or a similar material.

In certain embodiments, the shape of the barrier is supported by external reinforcing structures. The embodiment of FIG. 608 includes a plurality of bent metal rods 608 that can be located at intervals along the rear side of the barrier 600. The rods 608 include vertical sections 610 that can be placed against the back sides of cells at the rear of the barrier 600 so as to provide further resistance to horizontal forces applied to the front of the barrier.

In some embodiments, the barrier 600 can be initially inflated with air, so that the barrier 600 can be easily positioned while it is in its inflated configuration. The barrier 600 can then be filled with water, while the displaced air is released through a pressure valve 604 at the top of the barrier 600.

Figure 7:
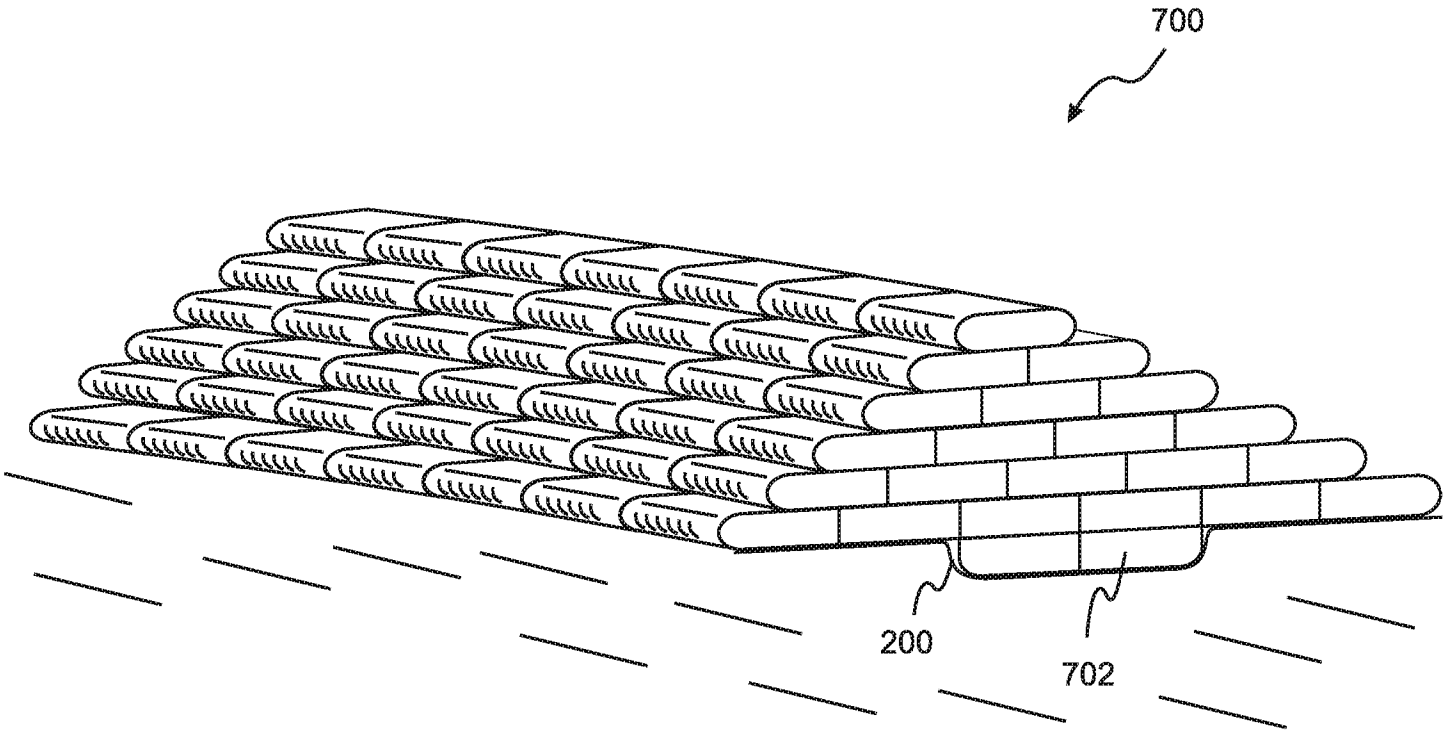
FIG. 7 is a perspective view of an embodiment that has two additional rows of cells at its base that are placed in a trench prepared at the construction site.

With reference to FIG. 7, in further embodiments, additional rows 702 of cells extend below the base of the inflatable barrier 700 so that they can be placed in a trench 200 prepared at the construction site, thereby further resisting dislodgement of the barrier 700 by flood waters or other forces.

Figure 8:
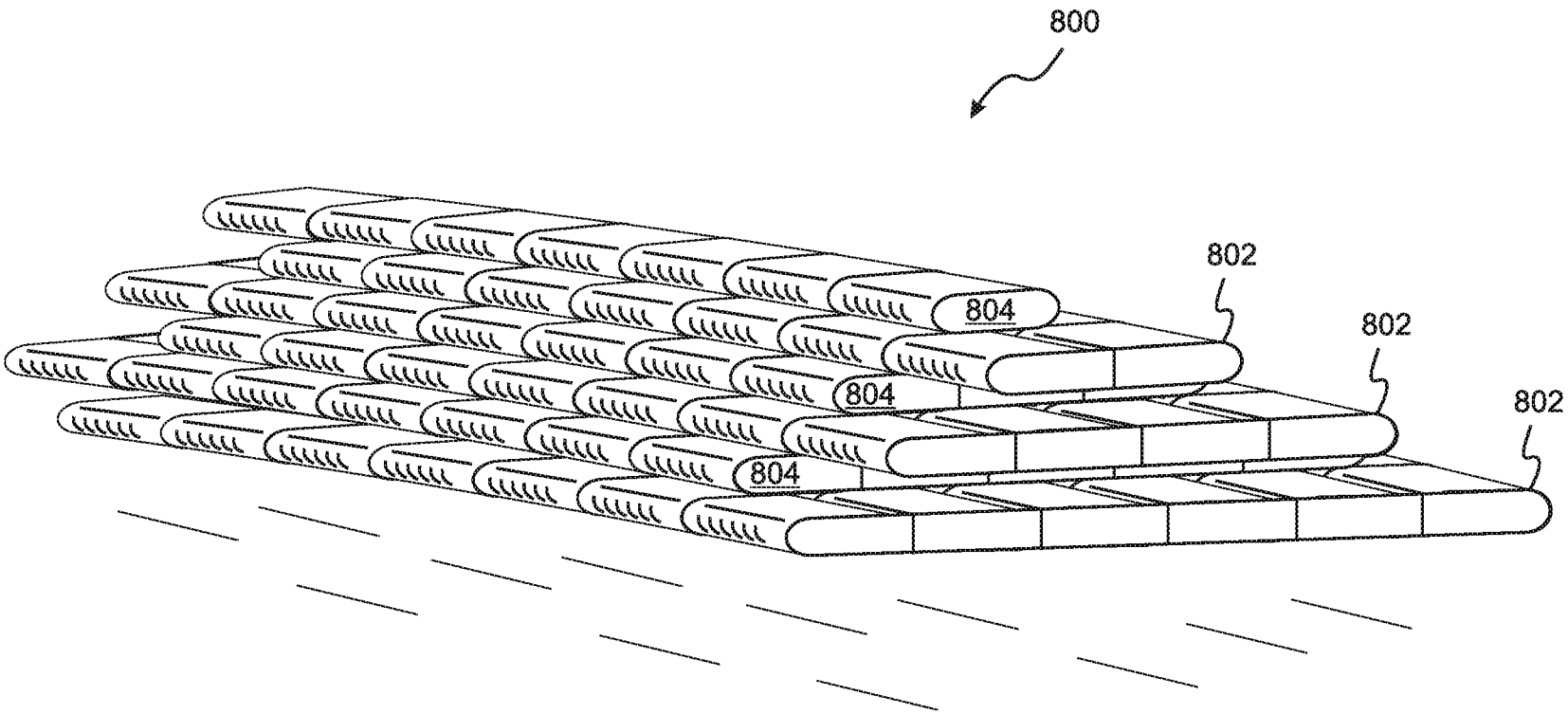
FIG. 8 is a perspective view of an embodiment that has interlocking ends.

In circumstances where a long wall or dike is required, a plurality of barriers of the present invention can be placed side-by-side. With reference to FIG. 8, in some embodiments the barriers 800 have interlocking ends that provide structural cooperation and a water-tight seal between adjacent barriers. In the embodiment of FIG. 8, alternate rows of cells 802 extend from the end by a length of one cell, while the interleaved rows 804 do not. The opposite pattern is provided on the other end of the barrier 800. It can be seen that a second barrier of the same configuration can be positioned so that its extended cells fit between the extended cells 802 of the adjacent barrier 800. In some of these embodiments, as mentioned above, the barrier 800 can be initially filled with air, and then positioned with the ends interlocking, after which the barriers are filled with water while the displaced air is allowed to escape through pressure valves provided at the tops of the barriers 800.

Figure 9A:
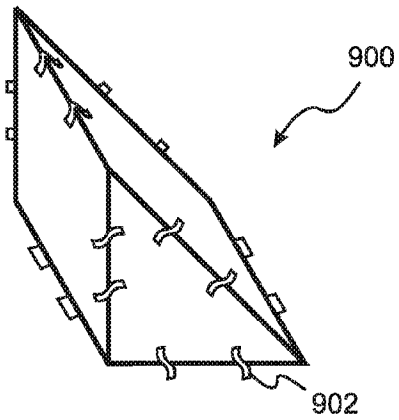
FIG. 9A is a perspective view of an individual, inflatable module having a triangular cross section that can be combined with similar modules to form a barrier in embodiments of the present invention.
Figure 9B:
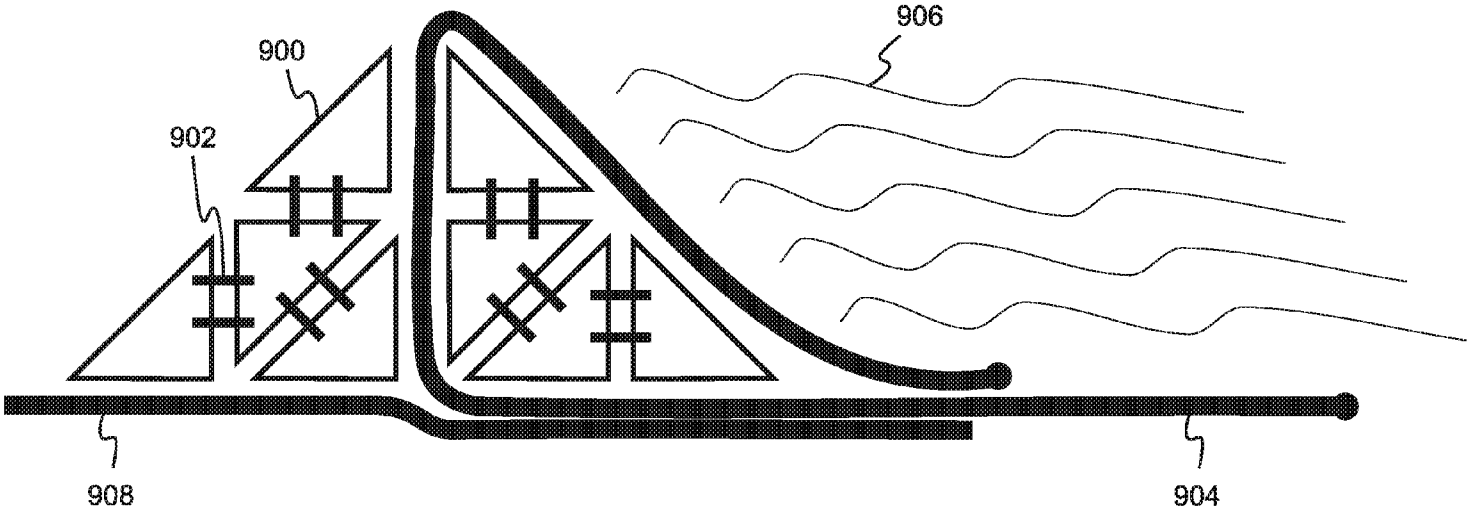
FIG. 9B is a cross-sectional view of a barrier constructed using the modules of FIG. 9A, and further including an anchoring sheet and an underlying sheet.

With reference to FIGS. 9A and 9B, in a second general aspect of the present invention the barrier is assembled from individual, water inflatable modules 900 that include attachment mechanisms 902 such as ties, hook-and-loop, or some other attachment mechanism known in the art. In the embodiment of FIGS. 9A and 9B, the modules have a triangular cross-sectional shape. As illustrated in FIG. 9B, this enables them to be assembled to form a barrier having a desired overall shape, such as a pyramid. While the base of the barrier is only slightly wider than the height in FIG. 9B, in other embodiments the base is at least six times as wide as the height.

In the embodiment of FIG. 9B, the sloping shape of the water-facing surface causes the water pressure to press the barrier against the ground and thereby increases friction and helps the barrier to resist being shifted horizontally by the water. The embodiment of FIG. 9B further includes an anchoring sheet 904 that is attached to the barrier and extends in front of the barrier, where it is pressed against the ground by the water 906 in front of the barrier, so that there is a high friction between the anchoring sheet 904 and the ground that further inhibits lateral movement of the barrier by the water 906.

The anchoring sheet in the embodiment of FIG. 9B is wrapped around the forward-located modules of the barrier, thereby attaching the anchoring sheet 904 to the barrier. In similar embodiments, the anchoring sheet 904 is wrapped around the entire barrier, or is attached to the barrier by some other means known in the art.

In some embodiments, the anchoring sheet 904 is sufficiently flexible to allow it to conform closely with the underlying shape of the water-facing surface. And in some of these embodiments, the anchoring sheet 904 is made from a material that naturally clings to the water-facing surface of the barrier due to static electrical attraction.

In embodiments, the flexible material of the barrier allows the base of the barrier to form a seal with ground even if the ground is rough. The embodiment of FIG. 9B further includes a flexible underlying sheet 908 that increases resistance to puncture of the barrier from beneath, and which forms a seal with the ground so as to further resist penetration of water beneath the barrier. In some of these embodiments, the underlying sheet 908 includes a cushioning layer such as foam or a puncture-proof air bag that enables the underlying sheet to form a seal with very rough ground, and also further helps to avoid puncture of the barrier from beneath. In certain of these embodiments, the underlying sheet 908 is filled with dry sand, foam or some other compliant material that will not get wet from the flood water.

Figure 10:
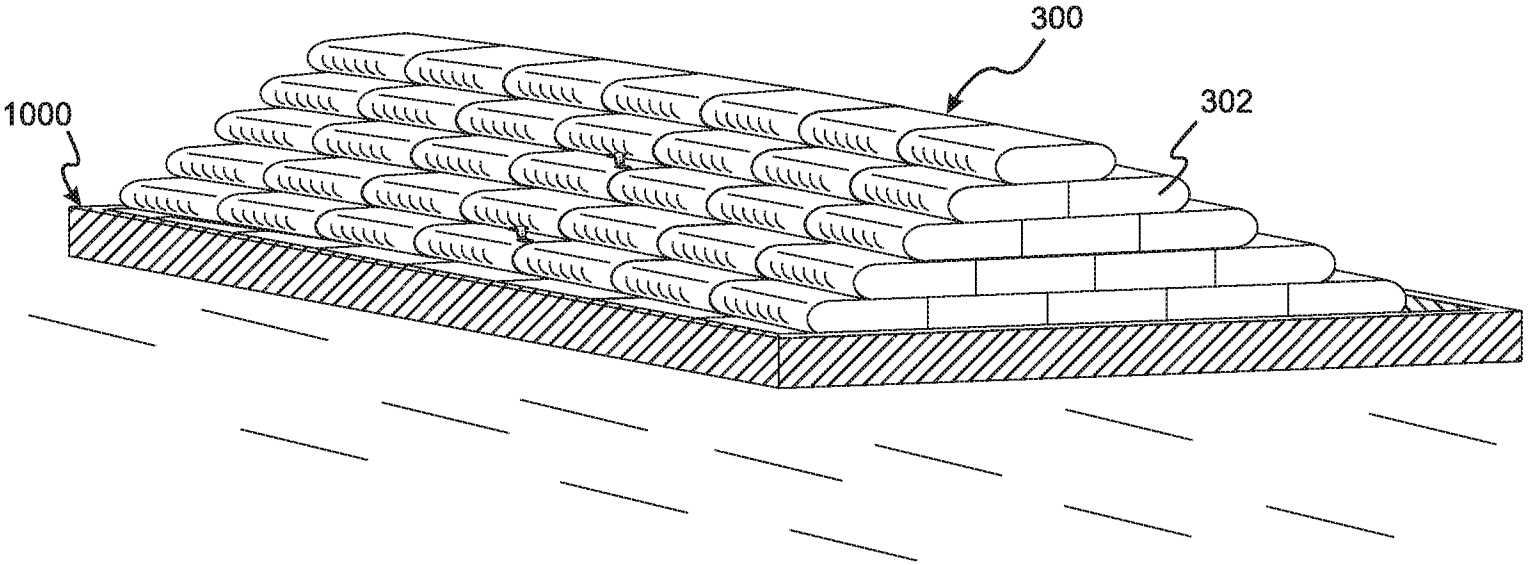
FIG. 10 is a perspective view of an embodiment of the present invention installed on a base with water inflatable sides.
Figure 11:
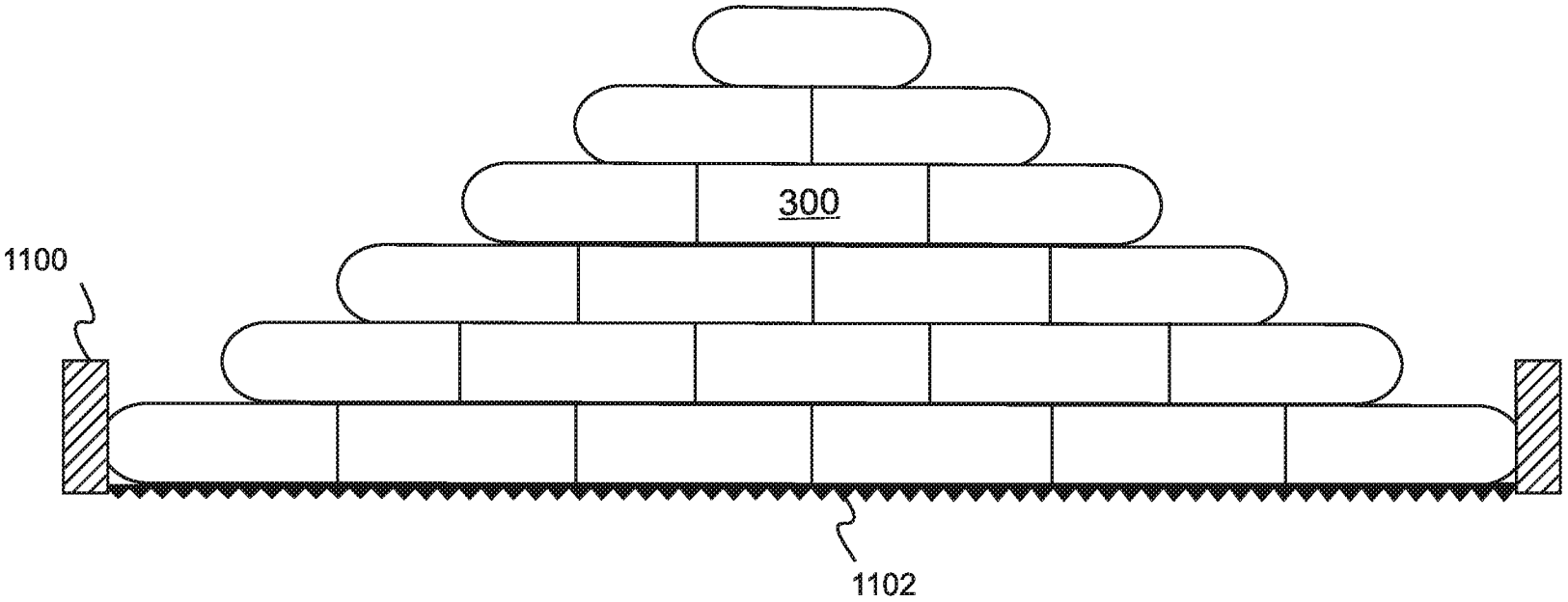
FIG. 11 is a cross-sectional view of the embodiment of FIG. 10.

With reference to FIGS. 10 through 15B, various embodiments include a separate, water inflatable base 1000 that can be used to adapt the barrier 300 to various features of the local terrane. The water inflatable base 300 includes front and back panels 1100 and two side panels 1500 that are configured to surround the barrier 300, as shown in FIG. 10. With reference to FIG. 11, at least the front and back panels 1100 of the circumference are water inflatable. In embodiments, support rods such as nylon rods (not shown) can be inserted into sleeves (not shown) provided in the side panels and/or the front and back panels for added structural support. In the embodiment of FIG. 10, the base is supported entirely by the water filled panels 1100, 1500 and by the barrier 300.

The base 1000 further includes a bottom panel 1102 configured for positioning beneath the barrier. In the embodiment of FIG. 11, the bottom panel 1102 is a single sheet of material, such as a plastic or woven sheet, and includes textural features that are configured to increase frictional attachment to the underlying surface.

Figure 12:
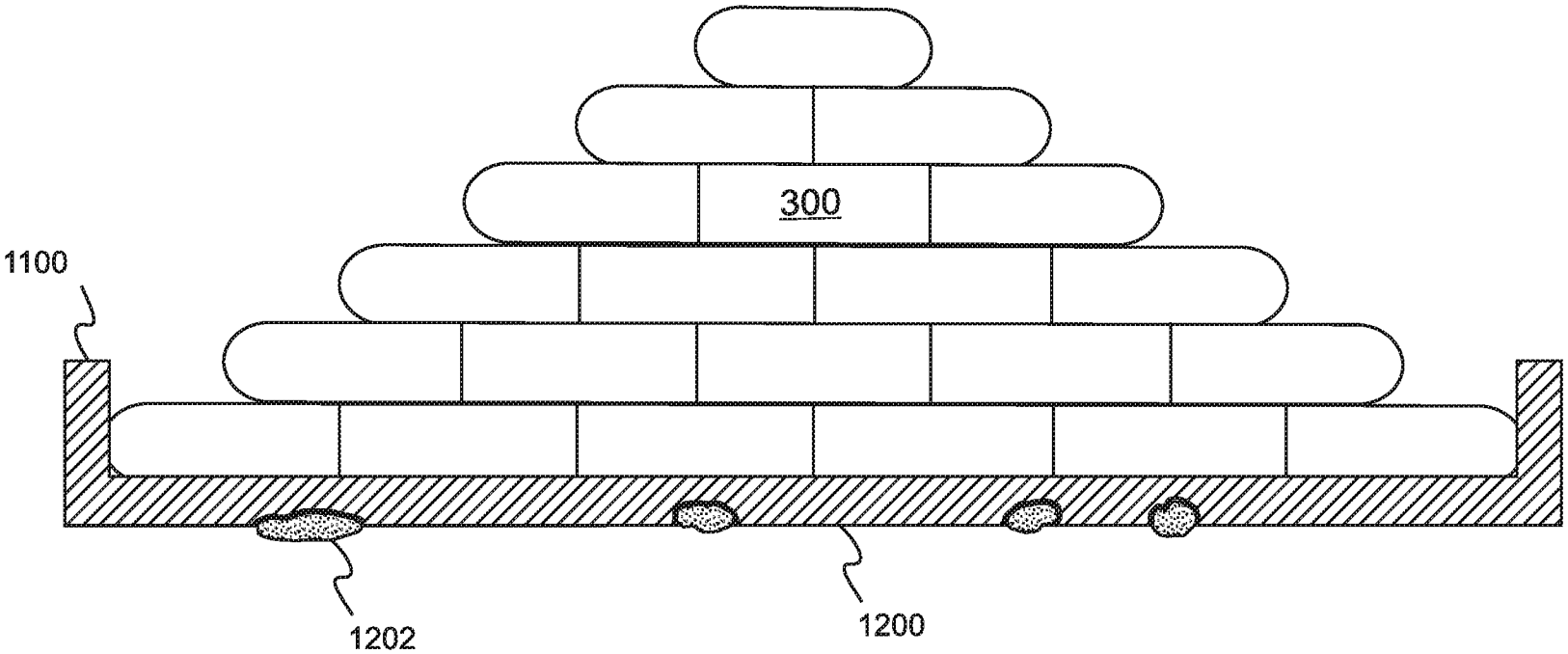
FIG. 12 is a cross-sectional view of an embodiment that includes a water inflatable bottom panel.

With reference to FIG. 12, in similar embodiments the bottom panel 1200 is also water inflatable, and is able to cushion and isolate the barrier 300 from stones 1202 and other irregularities that might be present in the underlying terrain.

Figure 13:
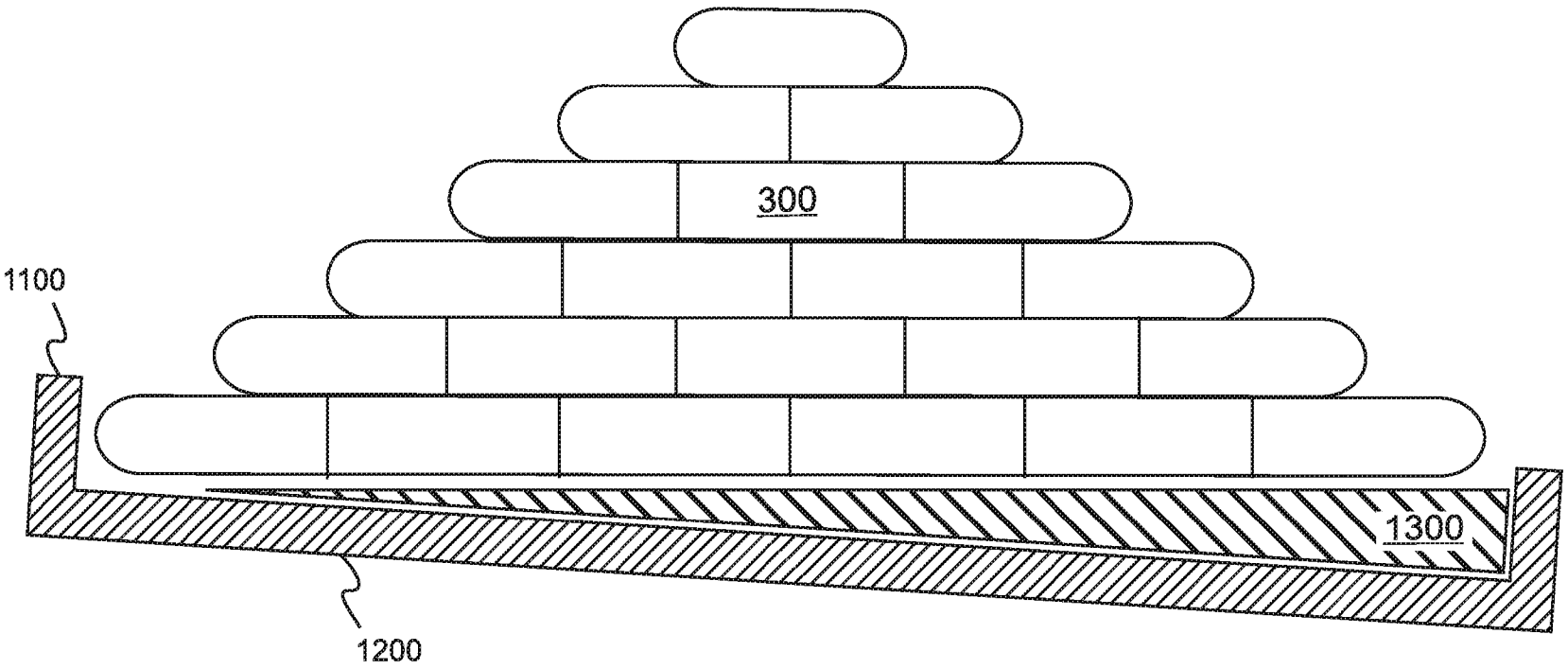
FIG. 13 is a cross-sectional view of an embodiment similar to FIG. 12, further including a wedge-shaped insert that provides a level platform for the barrier when the base is installed on sloping ground.
Figure 14:
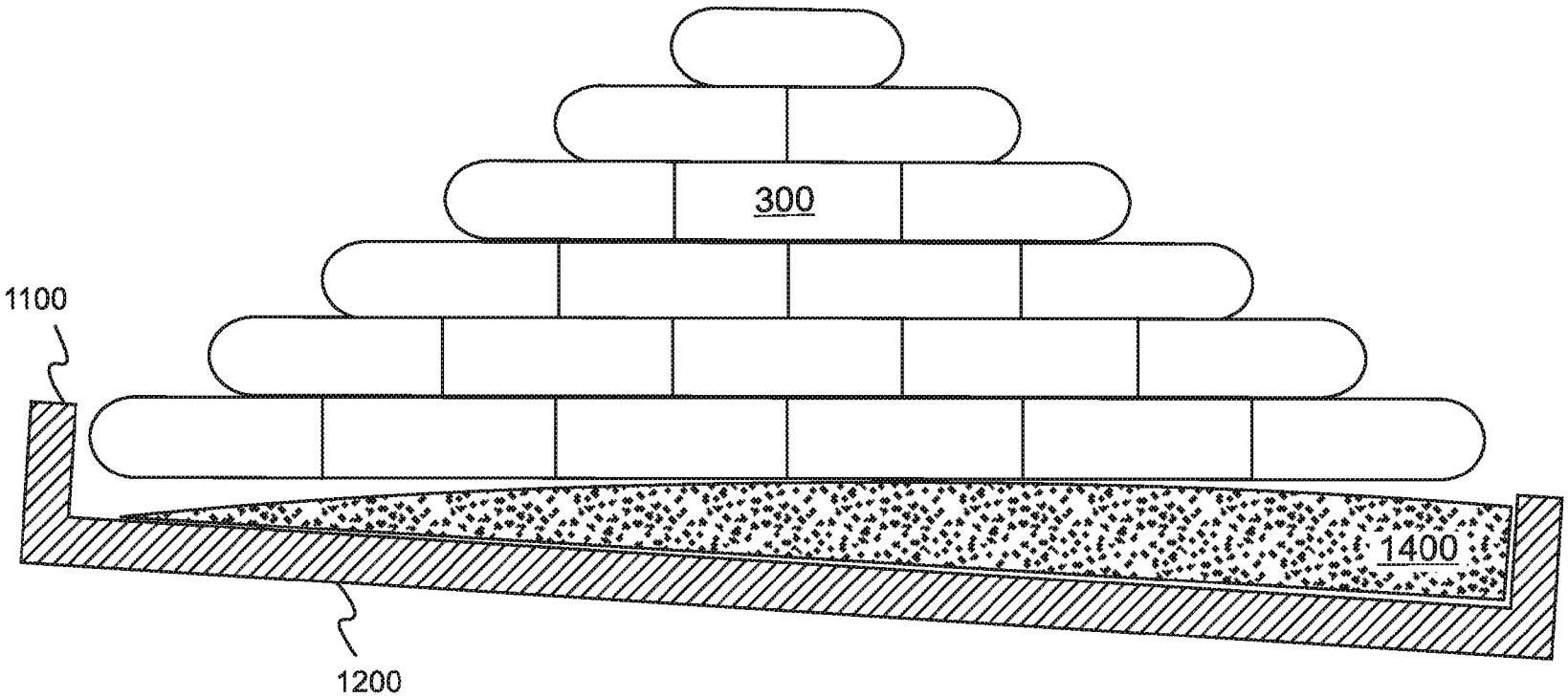
FIG. 14 is a cross section view of an embodiment similar to FIG. 12, further including a spray-foam layer applied to the base to provide a cushioned, level platform for the barrier.

With reference to FIG. 13, embodiments include at least one wedge-shaped insert 1300 that can be placed on top of or beneath the bottom panel (1100 or 1200) of the base 1000 so as to provide a level platform for the barrier 300 when the underlying ground is sloped. In method embodiments of the invention, where the barrier 300 is to be installed on an inclined or otherwise non-level surface, sand, spray foam, castable urethane, or another material is applied on top of the bottom panel (1100 or 1200) and allowed to solidify, so as to provide a level platform for the barrier 300. In the embodiment of FIG. 14, spray foam has been applied to the bottom panel 1200 in a manner that provides a substantially level platform that will support and further cushion the base 300.

Figure 15A:
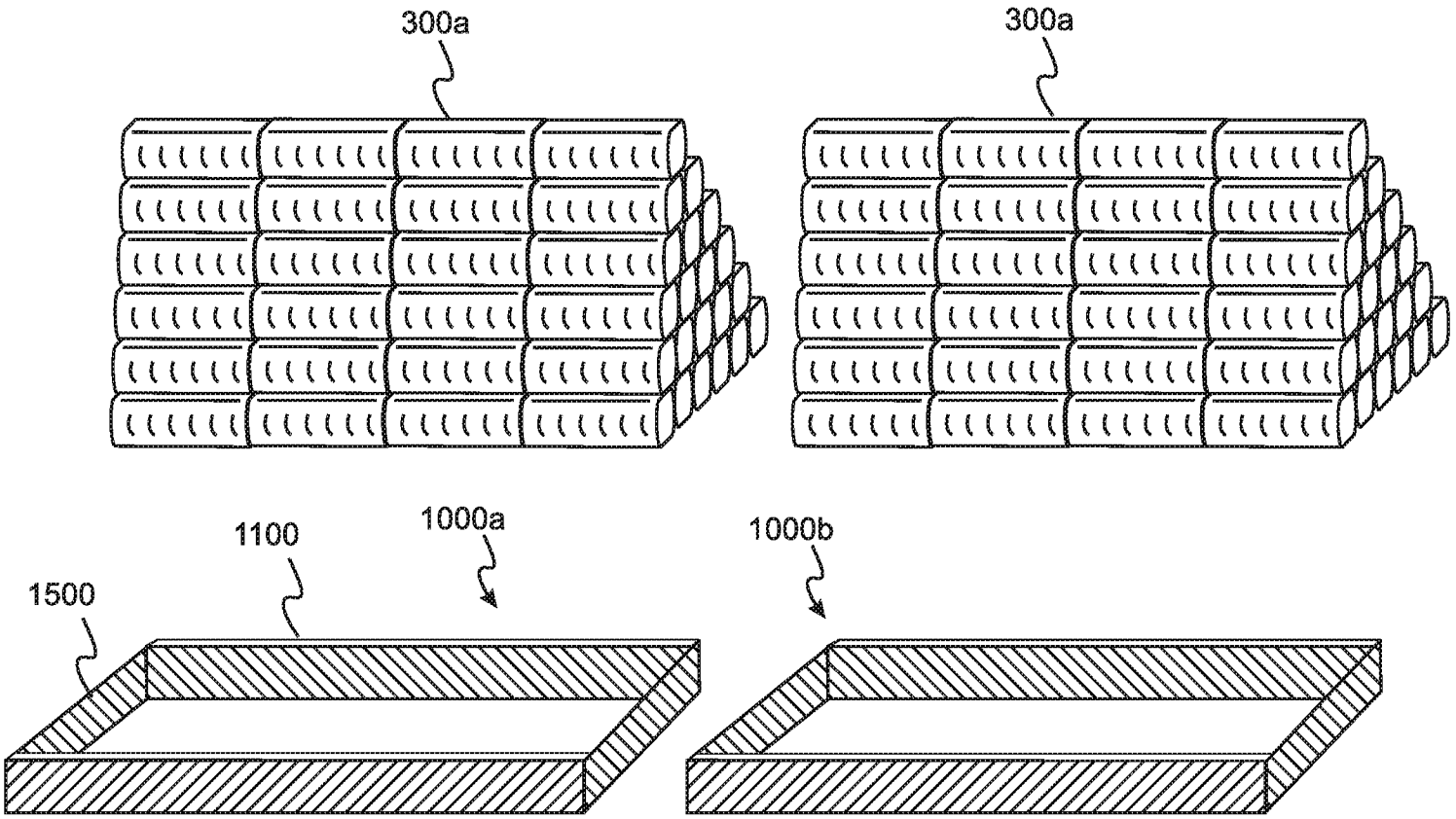
FIG. 15A is a perspective front view of two barriers shown above two bases having water inflatable front panels and flat side panels.
Figure 15B:
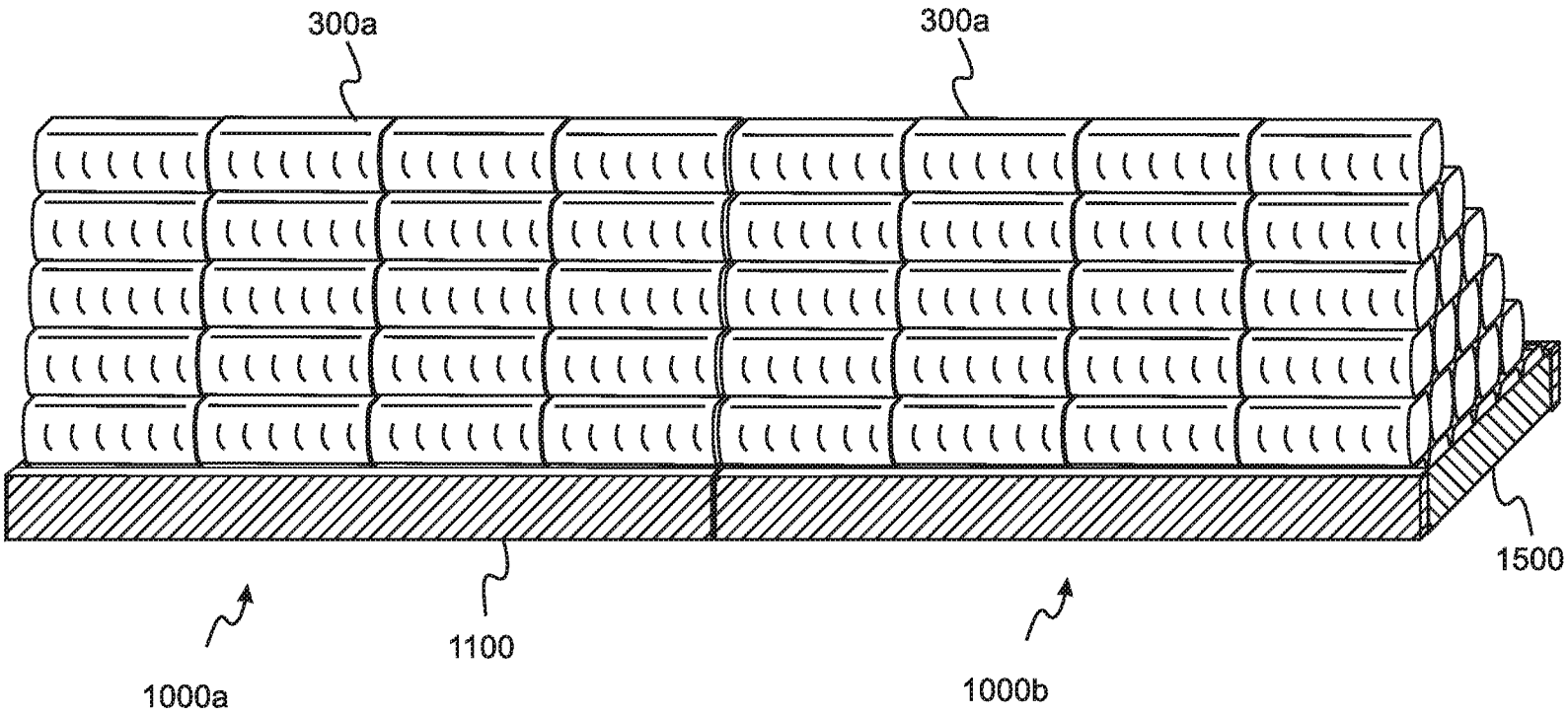
FIG. 15B is a perspective view from the front of the two barriers of FIG. 15A shown assembled with the bases and located adjacent to each other.

With reference to FIG. 15A, in embodiments the circumference of the base 1000 is water inflatable on two sides 1100 and flat on two sides 1500. This can be advantageous, for example, when a plurality of barriers 300*a*, 300*b* are to be placed adjacent to each other so as to create an elongated barrier. FIG. 15A is a front perspective view of two barriers 300*a*, 300*b* shown above two bases 1000*a*, 1000*b*, each of which includes water inflatable 1100 front and back panels, in combination with side panels 1500 that are single sheets. FIG. 15B shows the two barriers 300*a*, 300*b* and the two bases 1000*a*, 1000*b* assembled and placed adjacent to each other.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water inflatable barrier system comprising:

a barrier having:

flexible walls configured to contain water within an interior of the barrier, said barrier having a front, a rear, a length parallel to the front, a width perpendicular to the front, and a substantially uniform cross-section along its length, the cross section being wider at a bottom of the barrier than at a top of the barrier;

a plurality of substantially horizontal and substantially vertical partition walls dividing said interior of said barrier into a plurality of adjacent, water-tight cells shaped as rectangular parallelepipeds, front and rear partition walls of each cell being substantially parallel to the front of the barrier shell, said cells being arranged in a plurality of vertically stacked layers that are offset from each other such that none of the front and rear partition walls aligns with a front or rear partition wall in a vertically adjacent layer;

a water inlet in liquid communication with the barrier; and a plurality of passages between the cells of the barrier that are configured to allow filling of all of the cells of the barrier with water from the water inlet; and a base comprising:

a bottom panel configured to underlie the barrier; and a front panel, a back panel, and two side panels surrounding and attached to a circumference of the bottom panel, the front and back panels being water inflatable, and the front, back, and side panels being configured to extend above said bottom panel and to encircle the bottom of the barrier when the barrier is placed on the bottom panel.

2. The system of claim 1, wherein the bottom panel includes a structural feature on a lower side thereof that increases frictional attachment of the bottom panel to an underlying surface.

3. The system of claim 1, wherein the bottom panel is water inflatable.

4. The system of claim 1, wherein the two side panels are water inflatable.

5. The system of claim 1, further comprising at least one leveling wedge configured for placement on top of or below the bottom panel so as to provide a substantially level platform for support of the barrier when the base is installed on a sloping surface.

6. The system of claim 1, further comprising a support rod that can provide structural support to the base by attachment to one of the panels thereof.

7. The system of claim 1, further comprising an automatic valve cooperative with a vertical passage between adjacent cells and configured to automatically seal the vertical passage when the cell below the vertical passage is filled with water.

8. The system of claim 1, further comprising an automatic valve cooperative with a horizontal passage between adjacent cells and configured to automatically seal the horizontal passage when the cell located to the rear of the horizontal opening is filled with water.

9. The system of claim 1, wherein the barrier includes an interlocking side structure configured to interlock with a second barrier having a compatible side structure.

10. The system of claim 1, wherein the front panel of the base is reinforced due to inclusion of nanofiber in flexible walls thereof.

11. The system of claim 1, wherein the front panel of the base is reinforced due to double-walled construction.

12. The system of claim 1, wherein the flexible walls include a coating of a protective material that tends to seal punctures.

13. The system of claim 12, wherein the protective material is tyvec or liquid rubber.

14. The system of claim 1, further comprising a plurality of said barriers and bases, the side panels of the bases being non-inflatable flat panels, the barriers and base side panels being placed in an adjacent relationship so as to collectively form a water barrier, damn, or dyke.

15. A method of constructing a barrier assembly, the method comprising:

providing a barrier having:

flexible walls configured to contain water within an interior of the barrier, said barrier having a front, a rear, a length parallel to the front, a width perpendicular to the front, and a substantially uniform cross-section along its length, the cross section being wider at a bottom of the barrier than at a top of the barrier;

a plurality of substantially horizontal and substantially vertical partition walls dividing said interior of said barrier into a plurality of adjacent, water-tight cells shaped as rectangular parallelepipeds, front and rear partition walls of each cell being substantially parallel to the front of the barrier shell, said cells being arranged in a plurality of vertically stacked layers that are offset from each other such that none of the front and rear partition walls aligns with a front or rear partition wall in a vertically adjacent layer;

a water inlet in liquid communication with the barrier; and a plurality of passages between the cells of the barrier that are configured to allow filling of all of the cells of the barrier with water from the water inlet;

providing a base configured to underlie and surround the barrier, the base comprising:

a bottom panel configured to underlie the barrier; and a front panel, a back panel, and two side panels surrounding and attached to a circumference of the bottom panel, the front and back panels being water inflatable, and the front, back, and side panels being configured to extend above said bottom panel and to encircle the bottom of the barrier when the barrier is placed on the bottom panel;

placing the base at a desired location;

inflating the front and back panels of the base with water;

placing the barrier on the bottom panel of the base; and inflating the barrier with water.

16. The method of claim 15, wherein the side panels of the base are water inflatable, the method further comprising inflating the side panels of the base with water.

17. The method of claim 15, wherein the desired location is sloped, and the method further includes:

providing a leveling wedge; and placing the wedge onto or under the bottom panel of the base, thereby providing a substantially level platform upon which the barrier is placed.

18. The method of claim 15, wherein the desired location is sloped, and the method further includes:

after placing the base at the desired location, applying a leveling substance onto the bottom panel of the base so as to provide a substantially level platform upon which the barrier is placed.

19. The method of claim 18, wherein the leveling substance includes at least one of sand, soil, spray foam, and urethane.

20. The method of claim 15, further comprising:

providing a support rod; and attaching the support rod to the front, rear, or side panel of the base.

* * * * *